US008056875B2

(12) United States Patent
Spellman

(10) Patent No.: US 8,056,875 B2
(45) Date of Patent: Nov. 15, 2011

(54) BOTTLE MOUNTABLE CONDIMENT HOLDER

(76) Inventor: Edward F. Spellman, Lakewood, OH (US)

( * ) Notice: Subject to any disclaimer, the term of this patent is extended or adjusted under 35 U.S.C. 154(b) by 536 days.

(21) Appl. No.: 11/627,945

(22) Filed: Jan. 26, 2007

(65) Prior Publication Data

US 2007/0175773 A1 Aug. 2, 2007

Related U.S. Application Data

(60) Provisional application No. 60/762,841, filed on Jan. 27, 2006.

(51) Int. Cl.
*B65D 23/00* (2006.01)

(52) U.S. Cl. ..... 248/312; 248/102; 211/74; 220/735

(58) Field of Classification Search ..... 248/312, 248/102–104; 211/74, 77, 78, 85.31; 220/735, 220/743, 751, 737
See application file for complete search history.

(56) References Cited

U.S. PATENT DOCUMENTS

| | | | | | |
|---|---|---|---|---|---|
| 726,291 | A | | 4/1903 | Holmblad | |
| 942,138 | A | | 12/1909 | Gebhardt | |
| 1,938,466 | A | * | 12/1933 | Rubenstein | 211/74 |
| D112,062 | S | | 11/1938 | Fuerst | |
| D124,030 | S | | 12/1940 | Hommer | |
| D145,228 | S | | 7/1946 | Schilz | |
| 2,593,356 | A | * | 4/1952 | Smith | 211/119 |
| 2,694,512 | A | | 11/1954 | Morris | |
| 2,743,851 | A | | 5/1956 | Sellers | |
| D183,920 | S | | 11/1958 | Erstad | |
| 3,181,702 | A | * | 5/1965 | Raphael | 211/119 |
| D306,267 | S | | 2/1990 | Stewart | |
| 5,544,769 | A | * | 8/1996 | Dowler et al. | 215/227 |
| D378,195 | S | | 2/1997 | Bird | |
| D381,897 | S | | 8/1997 | Matthiesen | |
| 6,244,554 | B1 | * | 6/2001 | Baker | 248/312 |
| D445,305 | S | | 7/2001 | Dutour | |
| 6,519,883 | B2 | * | 2/2003 | Martorella | 40/358 |
| 6,599,482 | B1 | * | 7/2003 | Dorin et al. | 422/104 |
| 6,616,075 | B1 | | 9/2003 | Millerd | |
| D536,931 | S | | 2/2007 | Spellman | |
| 2006/0255050 | A1 | * | 11/2006 | MacCarthy | 220/737 |
| 2006/0261075 | A1 | * | 11/2006 | MacCarthy | 220/737 |

* cited by examiner

*Primary Examiner* — Terrell McKinnon
*Assistant Examiner* — Steven Marsh
(74) *Attorney, Agent, or Firm* — D.A. Stauffer Patent Services

(57) ABSTRACT

A bottle mountable condiment holder is mainly described as a lime slice and salt shaker holder for pivotingly mounting on a bottle of tequila such that the holder pivots to stay mostly upright while the bottle is tipped for pouring, thus preventing condiments from falling off of the rack. The holder includes a rack for holding the condiments and a pivoting attachment for mounting the rack to a bottle; such that the center of gravity of the rack is below a pivot of the pivoting attachment. Preferably the rack has shelves for holding condiment pieces (e.g., lime slices) and/or at least one dispenser mounted on the rack for dispensing particulate or liquid condiments (e.g., salt shakers). In a preferred embodiment, the pivoting attachment is a removable bottle neck collar, and the dispensers are removably mountable on the rack.

19 Claims, 6 Drawing Sheets

BOTTLE MOUNTABLE CONDIMENT HOLDER

CROSS-REFERENCE TO RELATED APPLICATIONS

This application claims the benefit of U.S. Provisional Patent Application No. 60/762,841, entitled TEQUILA BOTTLE LIME & SALT SHAKER HOLDER, and filed Jan. 27, 2006 by Edward F. Spellman.

This application is related to allowed, but not yet issued, U.S. Design patent application No. 29/253,946 entitled SALT SHAKER, and filed Feb. 15, 2006 by Edward F. Spellman.

TECHNICAL FIELD OF THE INVENTION

The present invention relates to racks mounted on a bottle, and more particularly to a condiment holder pivotingly mountable on a bottle.

BACKGROUND OF THE INVENTION

A popular way to drink tequila is by "shots". A "shot" is a small quantity (typically about 1 to 2 fluid ounces) of an alcoholic beverage, usually a liquor or spirit, which is ingested in one gulp. A small glass of suitable size that is generally used for this purpose is called a shot glass. In the United States and other places around the world, a traditional or common way to drink a shot of tequila is with salt and juice from a lime (some people use lemon in lieu of lime). Salt is first sprinkled on the back of one hand in the area between the index finger and thumb. The hand with the salt is used to hold a lime slice (or wedge) and the shot glass of tequila is held in the other hand. The shot is done by performing the following steps in rapid succession: 1) lick the salt from the back of the hand, 2) gulp down the tequila, and 3) squeeze the lime slice between the upper and lower teeth and suck out and swallow the juice.

In social settings shots are often "done" (imbibed) by two or more drinkers who share a bottle of tequila and the condiments, and the drinkers may want to do multiple shots in a single session. Therefore, to make this convenient there is a need to have a supply of multiple condiments (salt and lime slices) near at hand along with a bottle of tequila.

An object of the present invention is to provide a holder for condiments that will maintain a convenient presence for the condiments nearby to a bottle of liquid that will be used with the condiments. More particularly, it is an object that the condiment holder will hold condiment pieces and/or a particulate or liquid condiment in a dispenser. Most particularly, the type of condiment pieces held should include a plurality of fruit slices (e.g., lime wedges), and the particulate or liquid material should include salt, preferably dispensed by a shaker (e.g., salt shaker).

A further object of the present invention is to provide a condiment holder that attaches to a bottle in a way that pivots to maintain the holder in a substantially vertical orientation while the bottle is being tilted to pour liquid out of the bottle. In particular, it is an object that the inventive holder will pivotingly and removably attach to a tequila bottle such that lime or lemon slices and salt in a shaker will be close at hand for a person who is drinking the tequila.

A further object is to provide such a condiment holder that is practical, attractive and interesting, such that drinking shots will appeal to people at a commercial venue, e.g. a pub or bar, thereby enhancing sales of the beverage in the bottle.

A further object is to provide such a condiment holder that is practical, attractive and interesting, such that drinking shots will appeal to people at a private venue, e.g. a party, and thereby helping to stimulate conversation and increase the festive mood.

BRIEF SUMMARY OF THE INVENTION

The herein disclosed inventive bottle mountable condiment holder is mainly described with reference to a preferred embodiment: a lime slice and salt shaker holder for pivotingly mounting on a bottle of tequila. The holder's main components are a rack for the lime slices and/or particulate/liquid condiment dispensers mounted on the rack; and a pivoting attachment of the rack on the neck of a bottle. In the preferred embodiment, the pivoting attachment is a removable collar, and the dispensers are salt shakers that are removably mountable on the rack. The rack is free to swing on pivots when the bottle is tipped while pouring, thus keeping the rack in a mostly upright, i.e., vertical, orientation. This upright orientation prevents the lime slices and salt shakers from falling off of the rack while a drink is being poured out of the bottle.

The bottle mountable condiment holder has a unique, attractive, and functional design that adds to the fun and enjoyment of drinking shots (e.g., shots of tequila with lime and salt). When a commercial establishment, e.g., a pub or a bar, has the inventive holder on one of its bottles of tequila, for example, that bottle will stand out and sales of the bottle's tequila should increase. Preferably an attractive feature is shakers designed to appear like large bullets.

According to the invention a bottle mountable condiment holder comprises a rack that holds condiments; and a pivoting attachment for mounting the rack to a bottle; wherein: the center of gravity of the rack is below a pivot of the pivoting attachment.

Further according to the invention the condiment holder also comprises a collar that is mountable on the bottle in that the collar clasps a neck of the bottle; and a pivoting attachment of the rack to the collar, thereby making the collar a part of the pivoting attachment of the rack to the bottle. Preferably, the collar is designed to seat on a flared out portion of the neck of the bottle; the collar is removably mountable on the bottle; and a resilient cushion part of the collar is positioned such that the cushion seats on the neck of the bottle when the collar is mounted on the bottle.

Further according to the invention the condiment holder also comprises a shelf on the rack designed to support condiment pieces and/or a particulate or liquid condiment dispenser mounted on the rack. If present, the condiment dispenser can be removably mounted on the rack and preferably is a shaker.

Further according to the invention the condiment holder also comprises a friction washer in the pivoting attachment.

Further according to the invention the condiment holder also comprises a bridge part of the rack that extends upward and outward from the pivot to a crossing point that is 90 degrees from the pivot around a bottle upon which the holder is mounted; wherein the upward and outward extensions of the bridge are such that: the bridge at the crossing point is held against a neck of the bottle by the weight of the rack when the bottle is standing upright; and before it touches the bottle again, the bridge allows the bottle to be tilted for pouring at a maximum pouring angle greater than zero degrees up from a horizontal line to a longitudinal center axis of the bottle.

According to the invention a bottle mountable condiment holder comprises a rack that holds condiments; a collar that bottle-mounts by clasping a neck of the bottle; and a pivoting attachment of the rack to the collar; wherein the center of gravity of the rack is below a pivot of the pivoting attachment.

Further according to the invention the collar is removably mountable on the bottle; and is designed to seat on a flared out portion of the neck of the bottle. Preferably a resilient cushion part of the collar is positioned such that the cushion seats on the neck of the bottle when the collar is mounted on the bottle.

Further according to the invention the condiment holder also comprises a shelf on the rack designed to support condiment pieces.

Further according to the invention the condiment holder also comprises a particulate or liquid condiment dispenser removably mounted on the rack. Preferably the condiment dispenser is a shaker.

Further according to the invention the condiment holder also comprises a bridge part of the rack that extends upward and outward from the pivot to a crossing point that is 90 degrees from the pivot around the bottle upon which the holder is mounted; wherein the upward and outward extensions of the bridge are such that: the bridge at the crossing point is held against the neck of the bottle by the weight of the rack when the bottle is standing upright; and before it touches the bottle again, the bridge allows the bottle to be tilted for pouring at a maximum pouring angle greater than zero degrees up from a horizontal line to a longitudinal center axis of a bottom portion of the bottle.

Even further, preferably the rack comprises two vertically elongated hanger arms, a first hanger arm being pivotingly attached by a first pivot to a first side of the collar and a second hanger arm being pivotingly attached by a second pivot to a second side of the collar such that the first and second pivots are diametrically opposed; the bridge extends from each of the first and second pivots such that the bridge connects the first and second hanger arms; at least one of a plurality of condiment supporting shelves extends outward from each of the first and second hanger arms; a shaker type of condiment dispenser is removably mounted on each of the first and second hanger arms; and the collar is removably mountable on the bottle; is designed to seat on a flared out portion of the neck of the bottle; and a resilient cushion is adhered to the collar such that the cushion part of the collar seats on the neck of the bottle when the collar is mounted on the bottle. Also, preferably the condiment dispenser is designed to appear like a bullet; and the rack is mostly made of formed and welded wire.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1:
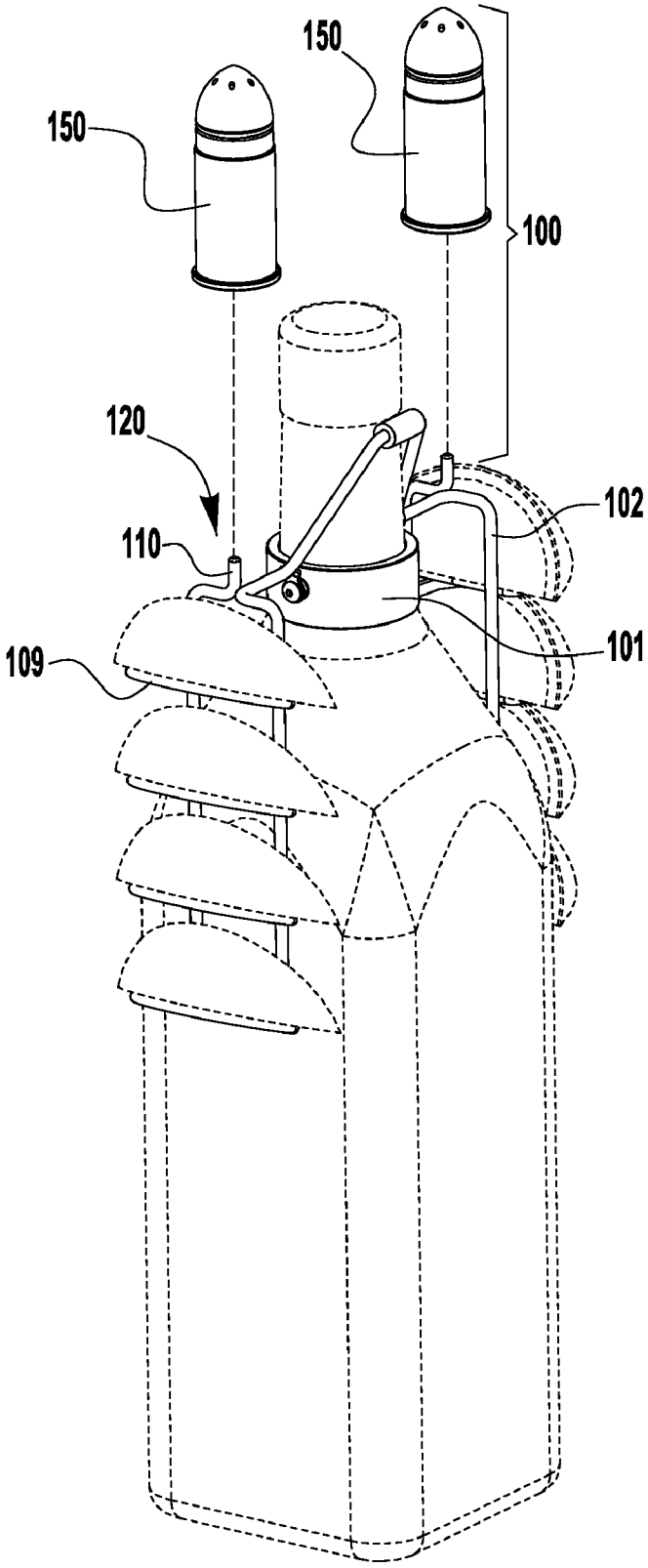

The structure, operation, and advantages of the present preferred embodiment of the invention will become further apparent upon consideration of the following description taken in conjunction with the accompanying drawings, wherein:

FIG. 1 is a perspective view of a bottle mountable condiment holder that is removably and pivotingly attached to a bottle (not part of the invention) and fully loaded with condiments (also not part of the invention), all according to the invention.

Figure 2:
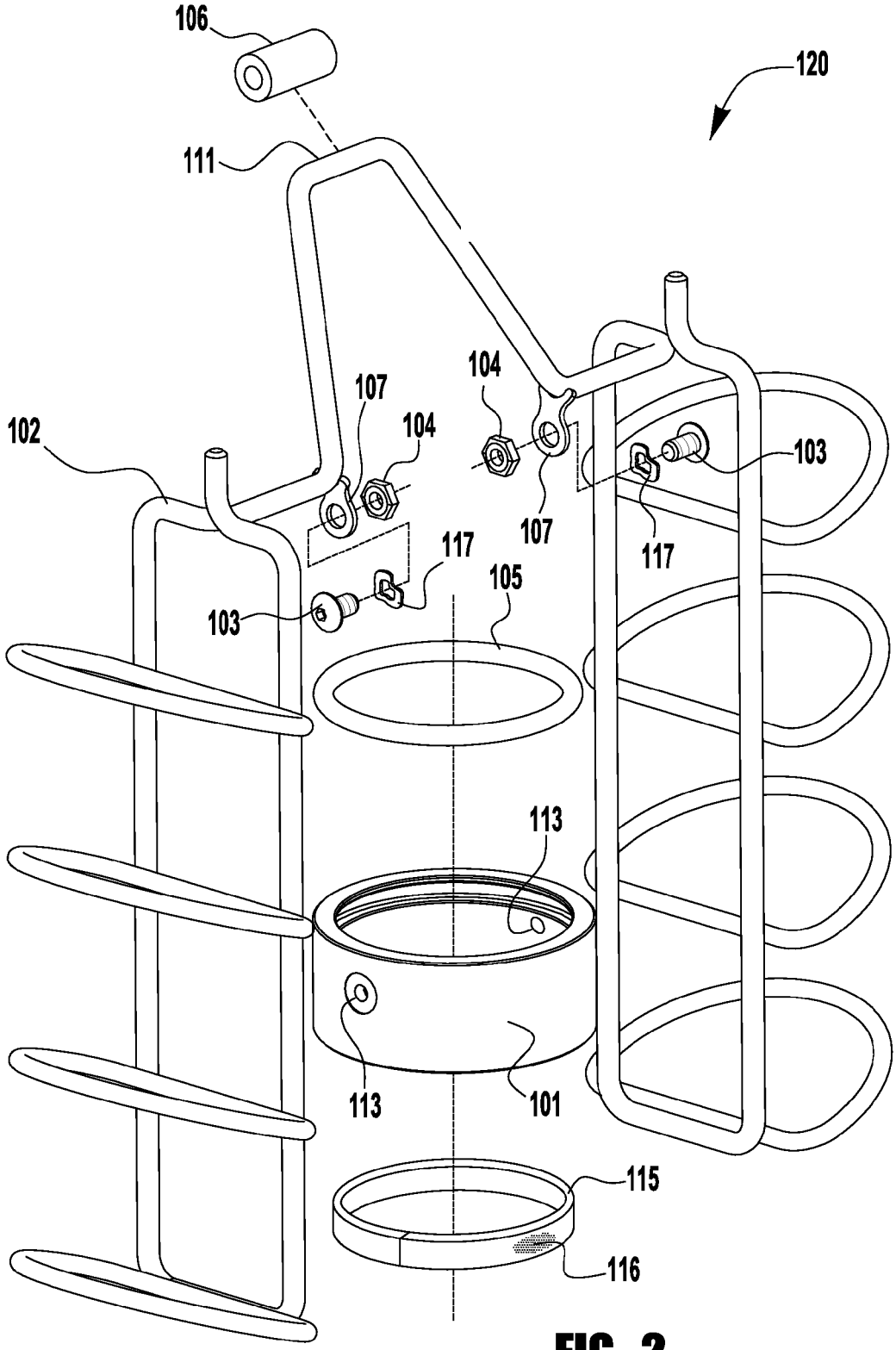

FIG. 2 is an exploded perspective view of a rack assembly portion of the holder of FIG. 1, all according to the invention.

Figure 3:
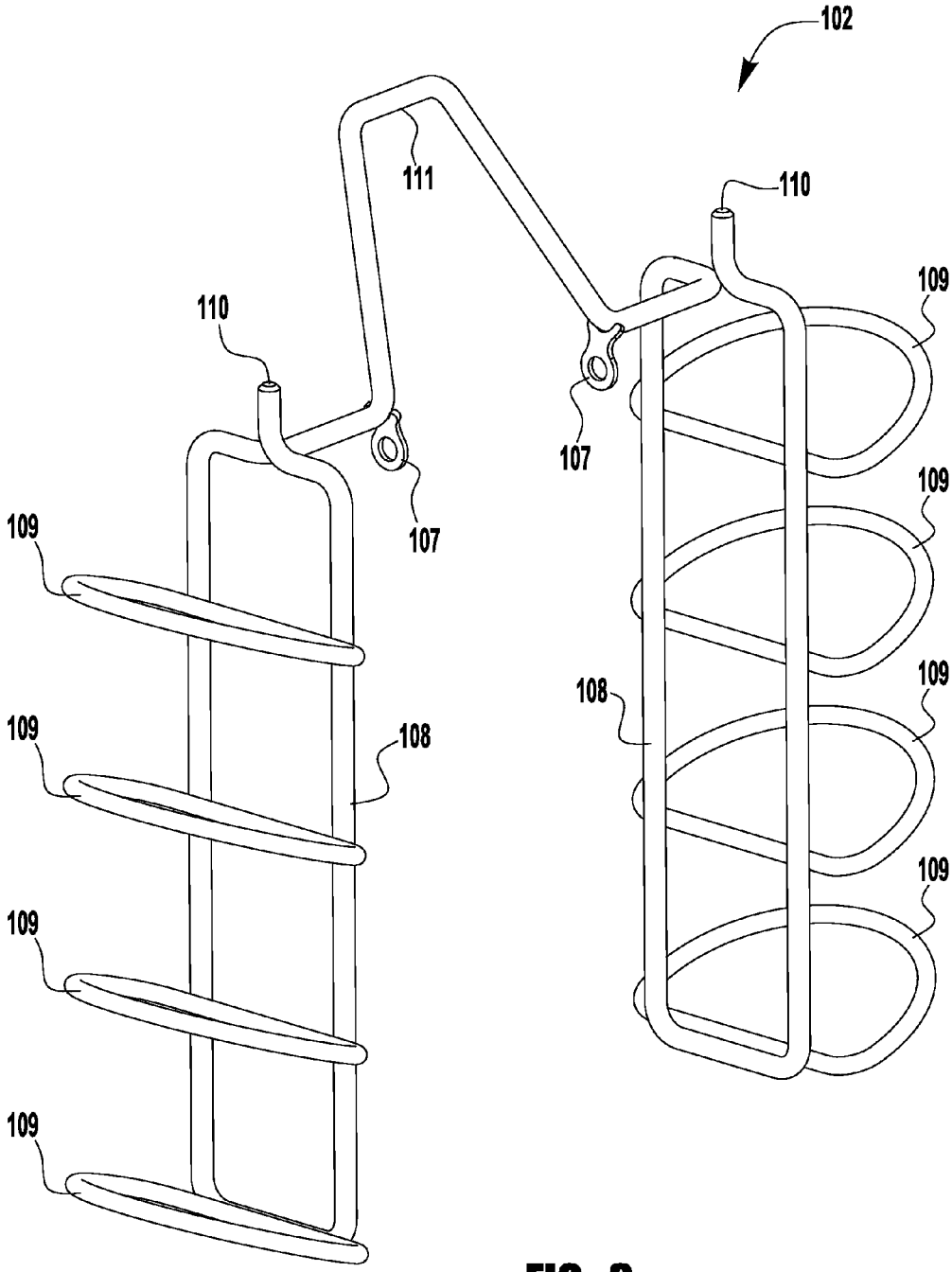

FIG. 3 is a perspective view of a rack portion of the rack assembly of FIG. 2, all according to the invention.

Figure 4:
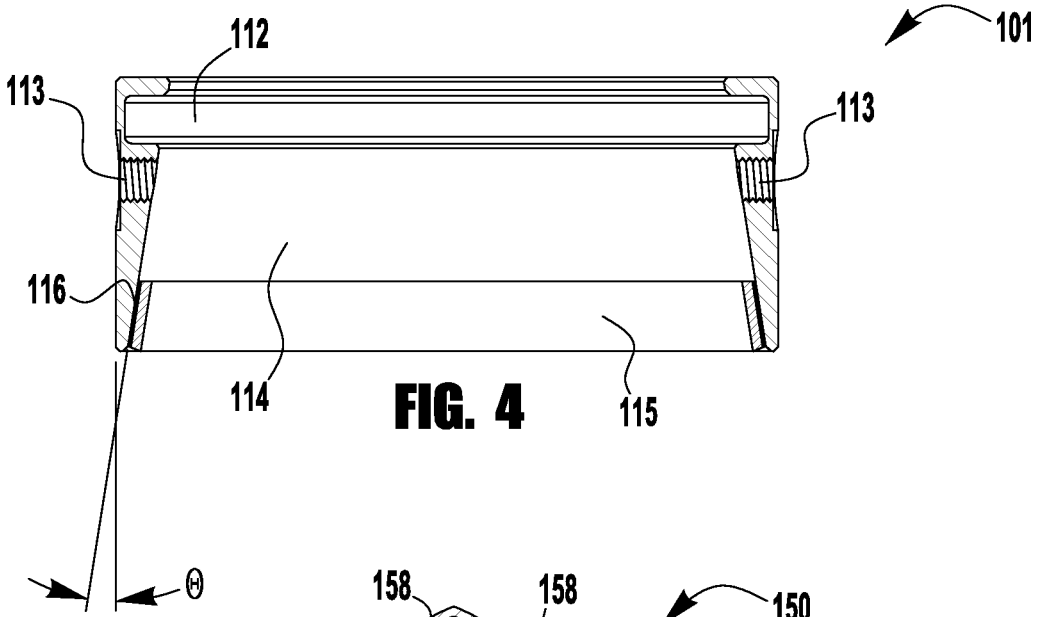

FIG. 4 is a vertical cross section view of a collar portion of the rack assembly of FIG. 2, but without an optional O-ring that was shown in FIG. 2, all according to the invention.

Figure 5:
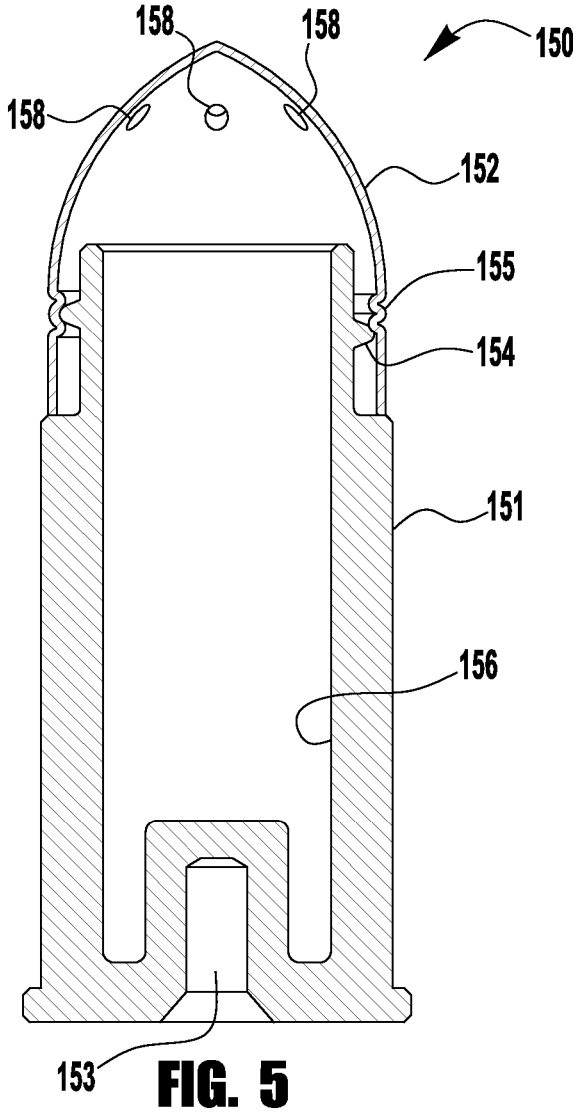

FIG. 5 is a vertical cross section view of a condiment dispenser portion of the holder of FIG. 1, all according to the invention.

Figure 6:
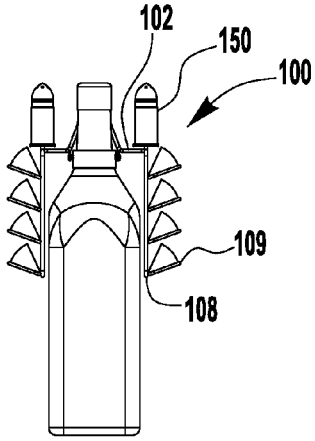
Figure 7:
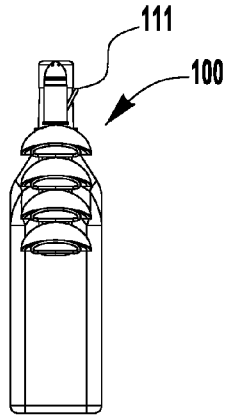
Figure 8:
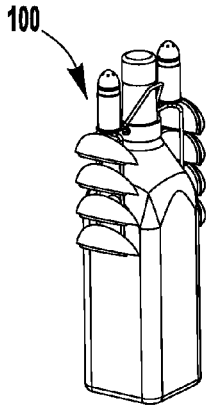

FIGS. 6, 7, and 8 are a front view, a side view, and a perspective front view, respectively, of the holder of FIG. 1 shown environmentally wherein exemplary condiments are fully loaded on the holder which is mounted on an exemplary bottle that is vertically oriented, all according to the invention.

Figure 9:
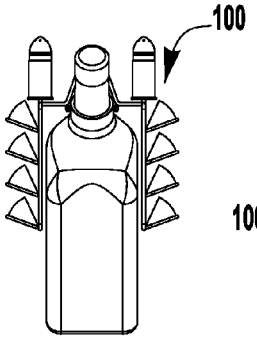
Figure 10:
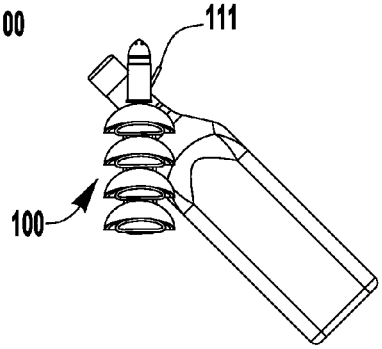
Figure 11:
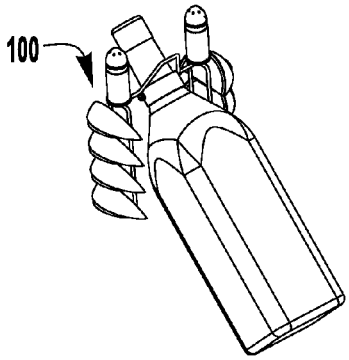

FIGS. 9, 10, and 11 are a front view, a side view, and a perspective front view, respectively, of the holder of FIG. 1 shown environmentally wherein exemplary condiments are fully loaded on the holder which is mounted on an exemplary bottle that is tilted as in the act of pouring, thereby illustrating the holder's maintenance of a vertical orientation, all according to the invention.

Figure 12:
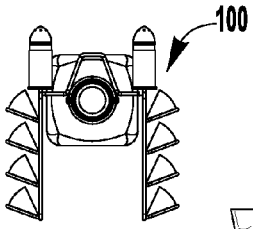

FIG. 12 is a front view of the holder of FIG. 1 shown environmentally wherein exemplary condiments are fully loaded on the holder which is mounted on an exemplary bottle that is tilted to a horizontal position as in the act of pouring, thereby illustrating the holder's maintenance of a vertical orientation, all according to the invention.

Figure 13:
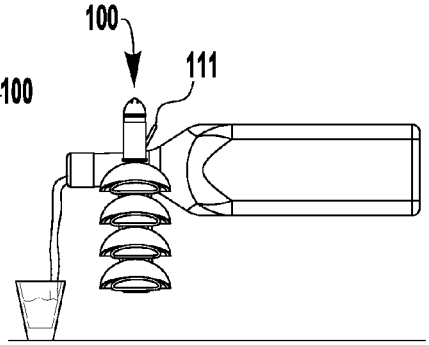

FIG. 13 is a side view of the holder of FIG. 1 shown environmentally wherein exemplary condiments are fully loaded on the holder which is mounted on an exemplary bottle that is tilted to a horizontal position, and further illustrating the act of pouring wherein an exemplary stream of liquid is flowing out of the bottle and into an exemplary shot glass, thereby illustrating the holder's maintenance of a vertical orientation while in use, all according to the invention.

Figure 14:
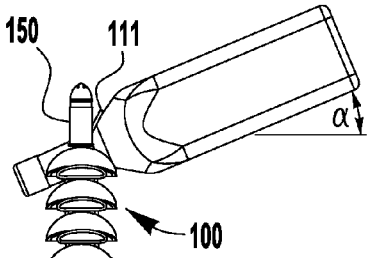

FIG. 14 is a side view of the holder of FIG. 1 shown environmentally wherein exemplary condiments are fully loaded on the holder which is mounted on an exemplary bottle that is tilted to a maximum pouring angle as limited by a bridge portion of the holder touching the bottle while the holder is still in a vertical orientation, all according to the invention.

Figure 15:
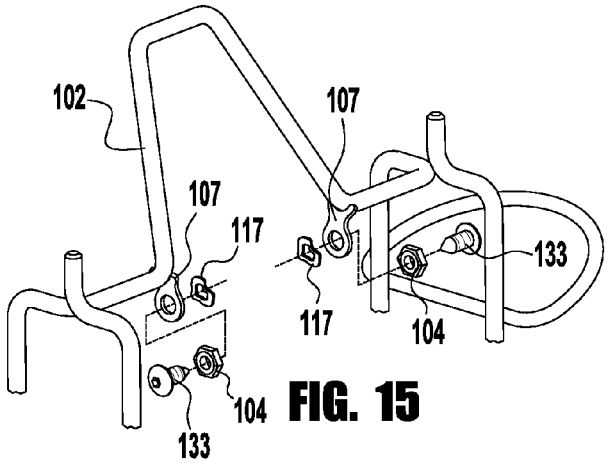

FIG. 15 is an exploded perspective view of a portion of the rack assembly of FIG. 2, but with an alternate embodiment of a pivoting attachment, all according to the invention.

Figure 16A:
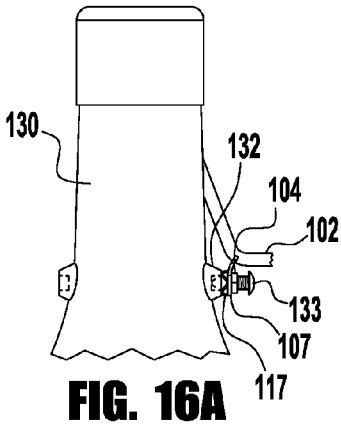

FIG. 16A is a side view of a bottle that is dimpled for a pivoting attachment, and showing one side of the rack assembly of FIG. 15 pivotingly attached to the dimpled bottle, all according to the invention.

Figure 16B:
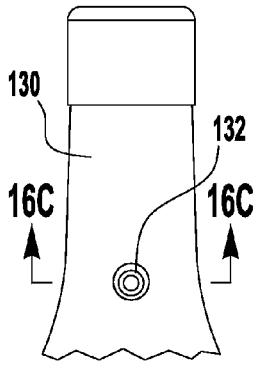

FIG. 16B is a 90 degree rotated view of a dimple on the bottle of FIG. 16A, all according to the invention.

Figure 16C:
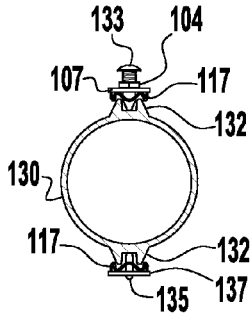

FIG. 16C is a cross-sectional view of the bottle taken along the 16C-16C line indicated in FIG. 16B, and showing the pivoting attachment of the rack assembly of FIG. 15 on the top of the Figure, but showing an alternate embodiment of the pivoting attachment on the bottom of the Figure, all according to the invention.

Figure 17:
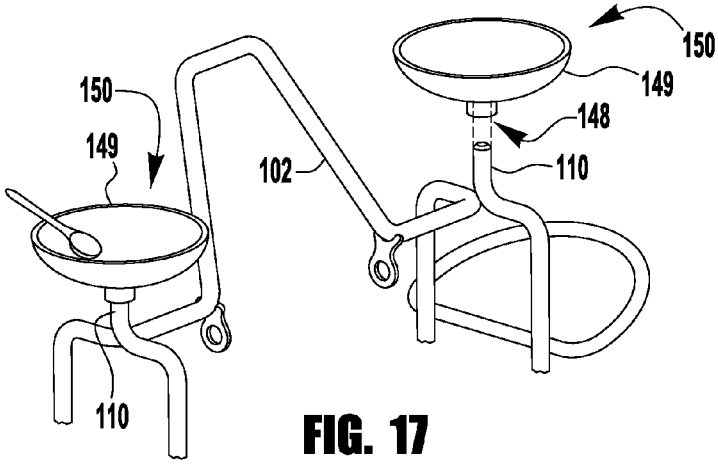

FIG. 17 shows a perspective view of an alternate embodiment of a dispenser being mounted on a rack portion of the holder of FIG. 1, all according to the invention.

Figure 18:
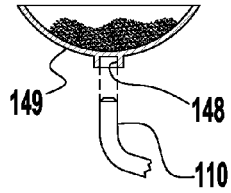

FIG. 18 is a cross-sectional side view of the dispenser of FIG. 17, all according to the invention.

DETAILED DESCRIPTION OF THE INVENTION

The present invention was originally developed for use in holding a plurality of lime or lemon slices (e.g., wedges) and a salt shaker on two opposed sides of a tequila bottle, thereby accommodating the needs of at least two tequila shot drinkers. Even more particularly, the prototype was developed for a shape and style of bottle that is particular to a single tequila vendor. Therefore the illustrative preferred embodiment of the invention is primarily shown and described herein in those specific terms. It should be apparent that the inventive concepts taught herein are obviously extendable to a much broader range of applications, not only to other condiments in liquid, particulate and/or pieced forms used with other alcoholic beverages, but also potentially to liquid, particulate and/or pieced materials that are used in conjunction with any pourable material in any bottle-like container that has a pouring opening on a neck that extends above a broader-dimensioned base. Thus the present invention is not limited by the particular embodiment(s) described, but rather by the full scope of devices and methods as they are defined in the claims.

Tequila bottles come in an array of shapes and sizes. An inventive condiment holder 100 was originally sized to fit Jose Cuervo Especial ("Gold") 750 ml and 1 liter bottles. Obviously the particular components of the holder 100 can be sized to fit other tequila makers' bottles as well as many other types of bottles, including bottle-like containers made of non-glass material.

Although not required, it is preferred to select materials and/or surface coatings for the holder 100 that minimize corrosion and enhance appearance. Furthermore, it is strongly preferred that the materials be safe for use in contact with edible food that is somewhat corrosive (e.g., salt and acidic fruit juice); and furthermore the materials should be washable in dishwashers, especially those used by bartenders. Thus, for example, the preferred embodiment is made using: stainless steel wire that is formed and welded; anodized aluminum; ABS plastic; nitrile rubber and/or silicone rubber; and the like.

Referring to FIG. 1, the inventive bottle mountable condiment holder 100 can be seen to have two major components: a rack 102 that preferably includes one or more dispenser mounts 110 (e.g., posts) upon each of which a dispenser 150 is removably mounted (shown removed); and a pivoting attachment of the rack 102 to a bottle (not part of the invention). The pivoting attachment combined with the rack 102 is a rack assembly 120. Preferably the rack assembly 120 includes a collar 101 to implement the pivoting attachment, wherein the collar 101 is designed to clasp a neck of the bottle such that the collar 101 will be held up by a portion of the bottle's neck that flares outward. Further preferably, the rack 102 includes a plurality of shelves 109 for holding condiment pieces (also not part of the invention) such as, for example, lime wedges.

FIG. 2 shows components of the preferred rack assembly 120. The rack 102 has two sides that are joined by a bridge 111. Since the bridge 111 can pivot into contact with the bottle when the bottle is returned from a tilted pouring orientation (e.g., FIG. 13) to a standing vertical orientation (as in FIG. 7), or when the bottle is tilted to a maximum pouring angle $\alpha$ (as in FIG. 14), an optional bumper sleeve 106 made of a resilient material may be wrapped around the bridge 111, however this is not preferred (as discussed below).

The pivoting attachment to the bottle is preferably in the form of a collar 101 that has either or both of an O-ring 105 and a collar cushion 115 that are secured inside the collar 101, for example by use of an adhesive 116 (preferably dishwasher safe). The collar 101 is pivotingly attached to the rack 102 by two screws that serve as pivots 103, each of which passes through a friction washer 117 (e.g., a wave washer), a bushing plate 107 that is welded onto the rack 102, a lock nut 104, and into a threaded screw socket 113 in the side of the collar 101. A suitable amount of friction for the rack pivoting about the collar 101 is set by tightening the screw pivots 103 to compress the friction washers 117 against the bushing plates 107, and then locking the pivots 103 into the screw sockets 113 by tightening the lock nuts 104 against the outside surface of the collar 101 (which is preferably spot faced as shown). Thus the pivots 103 become an axis for the pivoting action of the holder 100. Although the pivots 103 are shown as screws, it should be clear that the same pivoting action could be accomplished with solid posts, rods, protrusions, wire ends, and the like.

FIG. 3 shows preferred features of the rack 102. The rack 102 is, for example, a wire formed to provide attachment locations for the shelves 109 that are spaced apart along the vertically hanging hanger arm 108 on each side of the rack 102. For ease of cleaning, each shelf 109 is also wire, and the wire is formed into a D shape, butt welded together and welded to the hanger arm 108 without sediment-trapping open cavities/pockets. Preferably there are two hanger arms 108 spaced apart to accommodate the maximum width of a bottle for which it is designed, and joined together by the bridge 111. Further preferably there are a total of eight shelves 109 for holding an entire lime that has been sliced into eight wedge-shaped slices.

Above each hanger arm 108 there is a dispenser mount 110, preferably in the simple form of a short vertical post formed by an end of the formed wire of the rack 102. The post 110 mates with a corresponding post-hole like mounting cavity 153 in the bottom of the dispenser 150 (see FIG. 5). Some of the many obvious variations of a post-like dispenser mount 110 and mating mounting cavity 153 include, but are not limited to, a shelf with a magnet or hook-and-loop pads, a pocket for receiving the dispenser 150, a spring clip fitting around the dispenser 150, etc. Although these examples are for a preferred removable mounting of the dispenser 150, a non-removable mounting could easily be achieved using, for example, adhesive.

The bridge 111 extends upward and rearward from the bushing plates 107 which are located at either end of a diameter of the collar 101, and therefore of a bottle neck upon which the collar 101 rests. Referring also to FIGS. 7 and 14, it can be seen that the bridge 111 must be positioned such that it will just touch the side of the bottle neck when the bottle and the holder 100 are vertically oriented as in FIG. 7, and also such that the bridge 111 will allow the bottle to be tilted to a suitable maximum pouring angle α before the bridge 111 touches the bottle while the holder 100 is still vertically oriented. Of course such "suitability" of the angle α is a rather subjective design criterion. Preferably the maximum pouring angle α is sufficient to allow complete emptying of the bottle without tilting the holder 100 away from a vertical orientation, however a certain amount of tilt of the holder 100 can be sustained without causing the dispensers 150 or lime wedges to fall off so this is not a strict requirement, just a design goal. In other words, it is a design goal to form the bridge 111 such that it will allow a maximum pouring angle α greater than zero degrees up from a horizontal line to a longitudinal center axis of a bottom portion of the bottle.

Given the above description concerning the bridge 111, it can now be seen that the main purpose of the friction washer 117 is to add enough friction (a "suitable" amount) resisting the pivoting of the rack 102 so that it doesn't swing too fast when the bottle is tilted, thereby avoiding condiment pieces (usually the two lower ones since this portion of the rack 102 has the highest velocity) from being thrown off when the bridge 111 hits the bottle.

FIG. 4 shows an assembled collar 101 in cross section. An O-ring retention groove 112 is shown around the top inside of the collar 101, however this is optional, not preferred, because the O-ring 105 in the groove 112 protrudes inward to form the smallest inside diameter of the assembled collar 101 and therefore can get hung up on protruding parts of the bottle neck such as a foil seal, a bottle cap and/or screw threads for the cap. Thus the preferred design for the collar 101 would not have an O-ring 105 and an O-ring retention groove 112.

Preferably the collar 101 has an annular wall 114 that tapers from a minimum inside diameter at the top, to a maximum inside diameter at the bottom. The overall amount of taper is at an angle θ with respect to a vertical line (e.g., a cylindrically constant outside diameter). At the bottom of the collar 101 the collar cushion 115 is adhered inside the wall 114 by an adhesive 116. The taper angle θ is selected to be close to the nominal slant of the bottle neck where it flares outward at the bottom of the neck. The thickness and height of the collar cushion 115 are selected such that a relatively thin collar cushion 115 will not protrude inward enough to hang up on the protruding parts of the bottle neck top. The collar cushion 115 is made from a resilient but substantially compressible material (e.g., natural sponge rubber), so that the collar 101 will easily slide down around the bottle neck until the collar cushion 115 hits the flared-out bottom of the neck (a predetermined vertical position). Forcing the collar 101 down a bit more seats the collar 101 on the bottle neck by compressing the collar cushion 115 such that it grips the bottle neck at a predetermined vertical position and limits rocking of the collar 101. The compressed collar cushion 115 grips the bottle neck with sufficient force and the collar cushion 115 material has a high enough coefficient of friction to keep the fully loaded condiment holder 100 from: slipping along the bottle neck when the bottle is tipped past horizontal (as in FIG. 14), and twisting on (rotating around) the bottle neck during use.

Exemplary, but not limiting, nominal dimensions for a collar 101 embodiment that has worked on the abovementioned Cuervo bottle are as follows. The anodized aluminum collar wall 114 is 0.6" (inches) high and has a 9 degree taper from a minimum inside diameter of 1.2" to a maximum of 1.4" with an outside diameter of 1.45". The collar cushion 115 is a ribbon of 1/16" thick by 1/4" wide material that is cut to length and adhered into place (stretching the bottom as needed). Many variations of the disclosed collar 101 construction should be apparent to a designer of ordinary skill, including, for example, a constant inside diameter with an O-ring (e.g., 105) at the top; a sponge rubber ring 115 at the top and/or bottom inside; an O-ring 105 in place of the bottom sponge ring 115; etc.

FIGS. 15, 16A, B and C show an alternative embodiment of the inventive holder 100 wherein a modification of the bottle enables a pivoting attachment of the rack 102 to the bottle without the use of a collar 101. As shown in FIGS. 16A-C, a bottle 130 has a dimple 132 formed in the glass on diametrically opposed sides of the bottle 130 at a height suited to the rack 102 design, in this example just above a flared out bottom of the bottle neck at approximately the same height as the pivots 103 on the collar 101 when it is seated on a bottle neck. There are many ways to form a suitable dimple 132, i.e., a round depression, in glass. The illustrated example uses a built-up glass boss with the dimple 132 in its center. All surfaces are rounded and relatively smooth to avoid glass chipping and ease manufacturability and handling. For example, the boss is big enough to accommodate a dimple 132 that is about 0.14" deep and 0.13" wide at the bottom of the dimple 132.

In addition to the removal of collar 101, the rack assembly 120 only needs slight modification to adapt to this type of pivoting attachment. For example, the bushing plate 107 has a threaded hole, and the pivot 133 is a screw with a pointed or rounded tip. The pivot 133 is screwed into the lock nut 104 and then the bushing plate 107 until the tip of the pivot 133 extends a suitable amount (adjustable by turning the screw), at which point the lock nut 104 is tightened against the bushing plate 107. The friction washer 117 is placed on the pivot 133 before it is inserted into the dimple 132. Only the right side of the rack 102 is shown in FIG. 16A, but it should be understood that both sides would be the same. The rack 102 can be spread apart enough to allow insertion of both pivots 133 into the opposed dimples 132, and/or a pivot 133 can be screwed in and tightened after the rack 102 is put in place. Likewise, the pivot 133 can be tightened or loosened as needed to adjust the amount of friction that will be supplied by the friction washer 117 that is trapped between the top of the glass that surrounds the dimple 132 and the bushing plate 107. FIG. 16C shows the abovedescribed embodiment on the top side of the illustration, but on the bottom a variant is illustrated wherein the bushing plate 107 has been modified to be a pivot plate 137 that has a post-like pivot 135 that is fixed to it via, for example welding, bonding, staking, etc. The pivot plate 137 is simpler but doesn't allow adjustment of the pressure on the friction washer 117. Of course in either example, the friction washer 117 could be omitted and friction between the dimple 132 and the pivot 133, 135 could be used for the same purpose.

FIG. 5 shows a cross section of an assembled "shaker" type of dispenser 150. The overall shape and finish of the preferred dispenser 150 embodiment (a salt shaker—preferably as detailed in a co-pending related design patent application) are intended to suggest a bullet, which is in keeping with the concept of "doing shots". Of course this particular shape is not a functional requirement; any type of particulate or liquid material dispenser will do as long as it can be attached (preferably removably) to the rack 102 of the inventive holder 100. For example, although the dispenser 150 is preferably a salt shaker with suitable holes for dispensing a controllable amount of salt, the dispensed material could be any material that is in the form of relatively small particles (e.g., crystalline, powdered, seeds, ground, broken, crumbled, crushed, and so on), or liquid (e.g., hot sauce, lime juice, sugar solution, and so on). The dispenser 150 is illustrated as a "shaker"

but could be any dispenser suitable for dispensing the particulate/liquid material (e.g., a closed container with one or more dispensing holes through the top; e.g., a pepper-grinder type that contains material in larger pieces which it grinds and dispenses as ground-up material through the bottom of the dispenser). Furthermore, another type of suitable dispenser 150 is illustrated in FIGS. 17-18 as a cupped open-top saucer 149 for dispensing material in pinches or tiny spoonfuls, for example salt as shown in FIG. 18.

The preferred dispenser 150 embodiment that is illustrated in FIG. 5 is a salt-shaker type of dispenser having a vertically elongated, nominally cylindrical body 151, plus a removable shaker cap 152. The body 151 has an internal cavity 156 for holding the particulate material and the cap has one or more dispensing holes 158 so that the particulate material can be shaken out of the shaker 150. Of course this arrangement would also work with liquid by sprinkling it out of the dispensing holes 158. To make the cap 152 removable, the body 151 has threads 154 at the top which screwingly mate with corresponding threads 155 formed in the cap 152.

Preferably the dispenser 150 is removable from the rack 102. Thus in the preferred embodiment a short post-like dispenser mount 110 protrudes upward from the rack 102 (FIGS. 1 and 3) and the dispenser body 151 has a mating mounting cavity 153 that opens downward. Preferably the dispenser mount 110 and the mounting cavity 153 are made to relatively close tolerances such that the dispenser 150 is loose enough to prevent difficulty in removing or remounting it on the rack 102 (especially after several shots!); while at the same time not being so loose that the dispenser 150 wobbles rather than staying substantially vertical while it is mounted on the rack 102. For example, a 45 degree bevel leads into the mounting cavity 153, a 45 degree bevel is at the top of the dispenser mount 110, and there is a 0.005"+/−0.002" clearance between mounting cavity 153 and dispenser mount 110.

The following manufacturing method and materials are disclosed as a non-limiting example of a manufacturing method and materials that can be used to produce the bullet-like preferred embodiment of the dispenser 150. The body 151 is made of FDA certified ABS plastic, and its design accommodates efficient and short cycle injection molding. The body 151 is plated outside with polished brass for appearance. The cap 152 is die punched stainless steel with roll formed threads.

The open top dispenser 150 that is illustrated in FIGS. 17-18 has a cupped open-top saucer 149, with a mounting cavity 148 underneath. The mounting cavity 148 is sized to fit snugly over the dispenser mount 110. It can be made as a removable friction fit, or the mounting cavity 148 can be permanently adhered to the dispenser mount 110.

Many variations on the illustrated design for the condiment holder 100 will be apparent given the teachings of this disclosure, all of which are intended to be within the scope of the present invention. Some variations have been discussed hereinabove. Further examples of variations, not to be considered limiting, have been contemplated by the inventor and include the following.

- The hanger arm(s) 108 and the shelve(s) 109 can be replaced in part or entirety with one or more skewers for holding the condiment pieces (e.g., lime slices).
- The rack 102 can be one-sided or three-sided, having a corresponding number of hanger arms 108.
- More or less then eight shelves 109 can be used.
- More or less then two dispensers 150 can be used.
- The O-ring 105 and/or the collar cushion 115 can be replaced with one or more pieces (not necessarily annular) of felt, cork, rubber, or other material; or can be eliminated altogether.
- The collar 101 can be elastic or otherwise of adjustable diameter so as to fit many bottle neck sizes. Instead of a complete circular ring, the collar 101 can be other closed geometric shapes (e.g., square and hexagonal), or can be an open shape (e.g., three-sided square, C shaped, a springy clip, etc.). In general, the collar 101 merely needs to clasp the neck of the bottle.
- The bridge 111 can be eliminated, such that the one or more hanger arms 108 of the rack 102 can pivotingly hang from the collar 101 independently of each other.
- The friction washers 117 can be felt, cork, rubber, or other material; or can be eliminated altogether.
- The screw-type pivots 103 and lock nuts 104 can be replaced with pins or posts.

Operation

Referring now to all of the FIGS. 1-18, but particularly to FIGS. 6-14, the operation and use of the inventive bottle mountable condiment holder 100 will be discussed. It should be apparent how this illustration with reference to the preferred embodiment will apply to many other embodiments within the scope of the present invention as claimed.

The holder 100 is installed onto a tequila bottle by sliding the collar 101 over the bottle's neck so that the collar 101 is fully seated on the bottle neck such that the collar 101 is pressed down towards where the neck flares outward and the collar cushion 115 (and/or the O-ring 105), if present, is stretched and/or compressed between the bottle neck and the collar wall 114, thereby gripping the bottle. This gripping action helps keep the holder 100 from rotating around or lifting up off of the neck of the bottle. Since bottle necks typically taper outward from top to bottom, the collar 101, and thus the holder 100, will stay at a fixed vertical axial location relative to the bottle (even without a cushion 115 or an O-ring 105), but can still be easily removed. The bridge 111 (optionally cushioned with a bumper sleeve 106) is positioned above the collar 101 and close to, if not touching, the bottle neck. The holder 120 is properly installed on the bottle when the two shelf hanger arms 108 are hanging substantially parallel to the two side faces of the bottle (e.g., FIGS. 6-8), and the rack 102 is free to swing on the pivots 103 when the bottle is tipped forward (e.g., FIGS. 9-14).

Preferably the bridge 111 extends upward and outward from the pivots 103 (in the bushing plates 107) such that the bridge 111 or the bumper sleeve 106, if present, rests in contact with the neck of the bottle when the bottle is standing vertically. The point of contact at the middle of the bridge 111, where the bumper sleeve 106 would be attached, is a crossing point that is 90 degrees around the bottle from the pivots 103. To achieve the desired contact, for example, the bottle side of the bridge 111 at the crossing point is slightly inward of a vertical line tangent to the inner-most point on the inside perimeter of the collar 101. This bridge-bottle contact stabilizes the rack 102 on a standing bottle, thus making it easier to load/unload the rack 102 with condiment pieces (e.g., lime slices) on the shelves 109 and dispensers (e.g., salt shakers) 150 on the dispenser mounts 110.

When the bottle is tipped forward (away from the bridge 111) to pour a drink (FIGS. 10, 13, 14) the rack 102 swings on the pivots 103 to maintain a substantially upright, or vertical, orientation. This is due to the design that puts the center of gravity of the rack 102 below the holes in the bushing plates 107 (and therefore below the pivoting axis of the pivots 103), even when no lime slices are on the shelves 109 and both salt shakers 150 are full with salt and mounted on the dispenser mounts 110.

After pouring, the bottle is tilted back to a vertical standing position, for example progressing from FIG. 14 to 13 to 10 to 7. If done rapidly and/or carelessly, the bottle tilting action can cause the rack to swing a bit rather than staying vertical. The friction washers 117 help minimize and slow down any such rack swinging motion, and the bridge 111 keeps the rack 102 from swinging past the upright, or vertical, orientation. The optional bumper sleeve 106 can be used to cushion the impact of the bridge 111 against the bottle, but is not preferred since the bumper sleeve 106, being resilient, could cause some undesirable bouncing.

CONCLUSION

Thus has been described a device and method for providing a holder 100 for condiments that will maintain a convenient presence for the condiments nearby to a bottle of liquid that will be used with the condiments. The disclosed condiment holder 100 has a rack 102 that will hold condiment pieces (e.g., on shelves 109) and/or a particulate or liquid condiment in a dispenser 150. In a preferred use of the invention, the type of condiment pieces held are a plurality of fruit slices (e.g., eight lime wedges), and the particulate or liquid condiment is salt in a shaker type of dispenser 150.

Furthermore, the disclosed condiment holder 100 advantageously attaches to a bottle in a way that pivots to maintain the holder 100 in a substantially vertical orientation while the bottle is being tilted to pour liquid out of the bottle without spilling the condiments held by the holder 100. Even further, the condiment holder 100 preferably is removably attachable to a bottle. Thus the inventive holder 100 will pivotingly and removably attach to a bottle (e.g., a tequila bottle) such that condiments such as food pieces (e.g., lime wedges) and/or particulate or liquid condiments in a dispenser 150 (e.g., salt in a salt shaker) will be conveniently close at hand for a person who is consuming the contents of the bottle in combination with the condiments.

It can be seen that the disclosed invention provides a condiment holder 100 that is practical, attractive and interesting for one or more shot drinkers (for example), such that drinking of shots will appeal to people wherever the invention is displayed.

Although the invention has been illustrated and described in detail in the drawings and foregoing description, the same is to be considered as illustrative and not restrictive in character—it being understood that primarily preferred embodiments have been shown and described, and that all changes and modifications that come within the spirit of the invention as claimed are desired to be protected. Undoubtedly, many other "variations" on the "themes" set forth hereinabove will occur to one having ordinary skill in the art to which the present invention most nearly pertains, and such variations are intended to be within the scope of the invention disclosed herein.

What is claimed is:

1. A condiment holder for mounting to a bottle that stands upright with a vertically extending neck, the condiment holder comprising:

a rack for holding condiments;

a pivoting attachment for mounting the rack to the bottle; wherein the center of gravity of the rack is below a pivot of the pivoting attachment when the rack is mounted to the bottle neck; and a bridge part of the rack that extends upward and outward from the pivot to a crossing point that is 90 degrees from the pivot around the bottle; wherein the upward and outward extensions of the bridge are such that:

the bridge at the crossing point is held against the neck of the bottle by the weight of the rack when the bottle is standing upright; and before it touches the bottle again, the bridge allows the bottle to be tilted for pouring at a maximum pouring angle greater than zero degrees up from a horizontal line to a longitudinal center axis of a bottom portion of the bottle.

2. The condiment holder of claim 1, further comprising:

a collar that is mountable on the bottle in that the collar clasps a neck of the bottle; and a pivoting attachment of the rack to the collar, thereby making the collar a part of the pivoting attachment of the rack to the bottle.

3. The condiment holder of claim 2, wherein:

the collar is designed to seat on a flared out portion of the neck of the bottle.

4. The condiment holder of claim 2, wherein:

the collar is removably mountable on the bottle.

5. The condiment holder of claim 2, further comprising:

a resilient cushion part of the collar positioned such that the cushion seats on the neck of the bottle when the collar is mounted on the bottle.

6. The condiment holder of claim 1, further comprising:

a shelf on the rack designed to support condiment pieces.

7. The condiment holder of claim 1, further comprising:

a particulate or liquid condiment dispenser mounted on the rack.

8. The condiment holder of claim 7, wherein:

the condiment dispenser is removably mounted on the rack.

9. The condiment holder of claim 8, wherein:

the condiment dispenser is a shaker.

10. The condiment holder of claim 1, further comprising:

a friction washer in the pivoting attachment.

11. A bottle mountable condiment holder comprising:

a rack for holding condiments;

a particulate or liquid condiment dispenser removably mounted on the rack;

a collar that bottle-mounts by clasping a neck of a bottle;

a pivoting attachment of the rack to the collar; wherein:

the center of gravity of the rack is below a pivot of the pivoting attachment; and a bridge part of the rack that extends upward and outward from the pivot to a crossing point that is 90 degrees from the pivot around the bottle upon which the holder is mounted;

wherein the upward and outward extensions of the bridge are such that:

the bridge at the crossing point is held against the neck of the bottle by the weight of the rack when the bottle is standing upright; and before it touches the bottle again, the bridge allows the bottle to be tilted for pouring at a maximum pouring angle greater than zero degrees up from a horizontal line to a longitudinal center axis of a bottom portion of the bottle.

12. The condiment holder of claim 11, wherein the collar:

is removably mountable on the bottle; and is designed to seat on a flared out portion of the neck of the bottle.

13. The condiment holder of claim 11, further comprising:

a shelf on the rack designed to support condiment pieces.

14. The condiment holder of claim 11, wherein:
the condiment dispenser is a shaker.

15. The condiment holder of claim 11, further comprising:
a resilient cushion adhered to the collar such that the cushion part of the collar seats on the neck of the bottle when the collar is mounted on the bottle.

16. The condiment holder of claim 14, wherein:
the condiment dispenser is designed to appear like a bullet.

17. The condiment holder of claim 11, wherein:
the rack comprises two vertically elongated hanger arms, a first hanger arm being pivotingly attached by a first pivot to a first side of the collar and a second hanger arm being pivotingly attached by a second pivot to a second side of the collar such that the first and second pivots are diametrically opposed;
the bridge parts that extend from each of the first and second pivots are connected such that the bridge connects the first and second hanger arms;
at least one of a plurality of condiment supporting shelves extends outward from each of the first and second hanger arms;
a shaker type of condiment dispenser is removably mounted on each of the first and second hanger arms; and
the collar is removably mountable on the bottle, and is designed to seat on a flared out portion of the neck of the bottle.

18. The condiment holder of claim 1, wherein:
the pivoting attachment further comprises a collar;
and the rack further comprises:
two vertically elongated hanger arms, a first hanger arm being pivotingly attached by a first pivot to a first side of the collar and a second hanger arm being pivotingly attached by a second pivot to a second side of the collar such that the first and second pivots are diametrically opposed;
the bridge parts that extend from each of the first and second pivots are connected such that the bridge connects the first and second hanger arms;
a plurality of condiment supporting shelves extending outward from the first and second hanger arms; and
a particulate or liquid condiment dispenser.

19. The condiment holder of claim 18, wherein:
a shaker type of condiment dispenser is removably mounted on a hanger arm.

* * * * *